US005335987A

United States Patent [19]

Hodge et al.

[11] Patent Number: 5,335,987

[45] Date of Patent: Aug. 9, 1994

[54] CABINET WITH FLIPPER DOOR

[75] Inventors: David H. Hodge, Hopkins; Carl J. Geers, Scottville, both of Mich.

[73] Assignee: Metalworks, Inc., Ludington, Mich.

[21] Appl. No.: 44,779

[22] Filed: Apr. 12, 1993

[51] Int. Cl.[5] ..... A47B 88/00; A47B 95/00

[52] U.S. Cl. ..... 312/323; 312/110; 49/255

[58] Field of Search ..... 312/110, 331, 323; 49/255

[56] References Cited

U.S. PATENT DOCUMENTS

| | | | |
|---|---|---|---|
| 644,434 | 2/1900 | Macey . | |
| 657,017 | 8/1900 | Tobey . | |
| 726,411 | 4/1903 | Knight . | |
| 726,957 | 5/1903 | Macey . | |
| 761,312 | 5/1904 | Luellen . | |
| 1,288,665 | 12/1918 | Page . | |
| 2,258,948 | 10/1941 | Garrison . | |
| 3,093,429 | 6/1963 | Christen et al. | 312/331 |
| 3,339,995 | 9/1967 | Bencene . | |
| 3,650,590 | 3/1972 | Frederick et al. | 312/331 X |
| 3,748,005 | 7/1973 | Chovanec et al. . | |
| 3,794,401 | 2/1974 | Dean et al. . | |
| 4,265,502 | 5/1981 | Blodee et al. . | |
| 4,375,907 | 3/1983 | Vander Kooi et al. . | |
| 4,600,254 | 7/1986 | Whalen . | |
| 4,615,570 | 10/1986 | Goodman . | |
| 4,641,896 | 2/1987 | Iimura et al. . | |
| 4,729,612 | 3/1988 | Stone | 312/110 X |

*Primary Examiner*—Edward K. Look
*Assistant Examiner*—Hoang Nguyen
*Attorney, Agent, or Firm*—Ian C. McLeod

[57] ABSTRACT

A cabinet unit (10) with a flipper door (12) is described. The unit is formed by a top wall (10A), a bottom wall (10B) and two sidewalls (10C and 10D). A pair of brackets (14) having apertures (14A) are mounted on the inside surface (12C) of the flipper door. An axle (16) having two ends (16A) extends through the apertures Pinion gears (18) are mounted onto the two ends. A pair of U-shaped unitary members (30) which form a pair of racks (22) and a pair of guide ledges (26) are mounted on the inner surface (10I and 10J) of each sidewall. The pinion gears are provided with first teeth (18K) which rotatably engage the second teeth (22C) of the rack for allowing movement of the flipper door. The gears are also provided with second extensions (18D) which protrude into the U-shaped unitary piece just below the guide ledge to assist in stabilizing the flipper door during movement.

8 Claims, 3 Drawing Sheets

CABINET WITH FLIPPER DOOR

BACKGROUND OF THE INVENTION

Field of the Invention

The present invention relates to an improved cabinet unit with a flipper door. In particular, the present invention relates to a cabinet unit with a flipper door wherein movement of the flipper door is achieved through a rack and pinion assembly with additional stability during movement provided by a pinion retaining and guidance mechanism. In particular, the present invention relates to a guide rail which locate and guide the pinion.

Cabinets with flipper doors are well-known in the prior art. Flipper doors are opened by pulling the bottom of the door upward in a 90 ° are such that the door is parallel to the top wall of the cabinet. The flipper door is then slid into the opening adjacent the top wall such that the opening is completely exposed. The movement of the flipper door is usually accomplished through use of a rack and pinion assembly. Usually the rack is located on the inside of the sidewalls of the cabinet while the pinion is connected to an axle or rod which-is attached to the door by brackets or hinges. Illustrative of such cabinets with flipper door systems are U.S. Pat. No. 644,434 to Macey; U.S. Pat. No. 657,017 to Tobey; U.S. Pat. No. 726,411 to Knight; U.S. Pat. No. 726,957 to Macey; U.S. Pat. No. 761,312 to Luellen; U.S. Pat. No. 1,288,665 to Page; U.S. Pat. No. 3,339,995 to Bencene; U.S. Pat. No. 3,748,005 to Chovanec et al; U.S. Pat. No. 3,794,401 to Dean et al; U.S. Pat. No. 4,265,502 to Blodee et al; U.S. Pat. No. 4,375,907 to Vander Kooi et al; U.S. Pat. No. 4,600,254 to Whalen; and U.S. Pat. No. 4,641,896 to Iimura et al.

U.S. Pat. No. 2,258,948 to Garrison describes a bookcase unit with a drop door which uses a rack and pinion system similar to that used with a flipper door. However, instead of the door swinging outward and being stored adjacent to the top wall, the rack and pinion system is used to drop the door vertically down past the bottom of the unit. The pinion is attached to a rod which extends through loops in the hinges located at the top of the door. A runway located on the front inner sides of the bookcase contains a deep portion and a shallow portion. The shallow portion contains the rack which coacts with the pinion and allows the door to drop smoothly. The deep portion is engaged by the end of the rod which extends through the pinion. A spring is also provided around the rod which assists to counteract the effects of gravity and to achieve a more gradual dropping of the door. This door style lacks the space saving feature of the flipper door and tends to hinder access to lower cabinets or shelves.

U.S. Pat. No. 4,615,570 to Goodman describes a cabinet with a flipper door which is stored horizontally above the top wall of the cabinet when in the open position. The flipper door is operated by a rack and pinion assembly. The rack is located on the upper inside wall of the cabinet and includes a lower guide channel. The pinion gears are rotatably coupled to each other by a transverse axle. The terminal ends of the axle extend through the pinion gears and slidably engage the lower guide channel. The flipper door of the cabinet is larger than the cabinet opening in order to cover the edges of the side walls when the door is closed. The rack is also provided with an upper guide channel. A link is attached between the transverse axle of the rack and pinion assembly and the door hinges. The stud shaft which secures the link to the hinge extends past the link to slidably engage the upper guide channel and to create a pivot axis which is shifted forward a sufficient amount to accommodate the extra width of the flipper door. The configuration of the door in this reference requires extra space above the cabinet for the door which also prevents stacking of the cabinets.

None of the above references provide a cabinet with a hidden flipper door which employs a stable opening and closing mechanism utilizing a rack and pinion system with a guide rail. There remains a need for a mechanism for a flipper door which will prevent excessive extraneous movement of the pinion gear and thus the door during opening and closing of the door, and allow for easier opening and closing of the door.

OBJECTS

It is therefore an object of the present invention to provide a cabinet with a hidden flipper door which is easy to open and close. Further, it is an object of the invention to provide a guidance mechanism in addition to the rack and pinion assembly in a cabinet using a flipper door to add stability to the flipper door when being opened or closed. Still further it is an object of the invention to create a sturdy opening and closing mechanism for a flipper door which is easy to manufacture and to install. These and other objects will become increasingly apparent by reference to the following description and the drawings.

DETAILED DESCRIPTION OF THE PREFERRED EMBODIMENT

The present invention relates to a cabinet unit comprising; a casing means having a top wall and a bottom wall spaced apart parallel to a horizontal axis with two opposed sidewalls, connected to the top wall and bottom wall each sidewall having a front portion and a back portion with an inner surface therebetween wherein the walls together provide a front opening in the casing; a flipper door means having a top portion and a bottom portion adapted for covering the front opening; a pair of rack means mounted on the inner surface of each sidewall of the casing parallel to a plane of the horizontal axis each having a proximal end located toward the front opening in the casing and a distal end at the back portion and each with first teeth pointed toward the top wall; a pair of pinion gear means mounted on the door means each having a first extension and a second extension with a central portion having an outer surface extending therebetween and a center bore extending through the first extension, central portion and second extension wherein the outer surface of the central portion is provided with second teeth to rotatably engage the first teeth of the rack means; a pair of guide means located above and parallel to the rack means wherein the second extension of the pinion gear means slidably engages the guide means to provide guidance for the flipper door means during opening and closing; a pair of bracket means mounted at the top portion of the flipper door means provided with an inner side and an outer side with an aperture therebetween in a plane perpendicular to the axis wherein the first extension of the pinion gear means extends through the aperture of the bracket means such that the central portion of the pinion gear means is adjacent the outer side of the bracket means wherein the bracket means pivotally mounts the flipper door means onto the casing means; an axle means extending parallel to the axis having two opposed ends wherein each end extends through the aperture in the bracket means and through the center bore of the pinion gear means for mounting the pair of pinion gear means onto the flipper door such that the axle means and pinion gear means rotate together and wherein the pinion gear means is slidable along the axle means to the extent permitted by the guide means and the bracket means; and a pair of stop means mounted at the front portion of each sidewall and located in line with the guide means to prevent the second extension of the pinion gear means from moving off the guide means when the door is closed.

Figure 1:
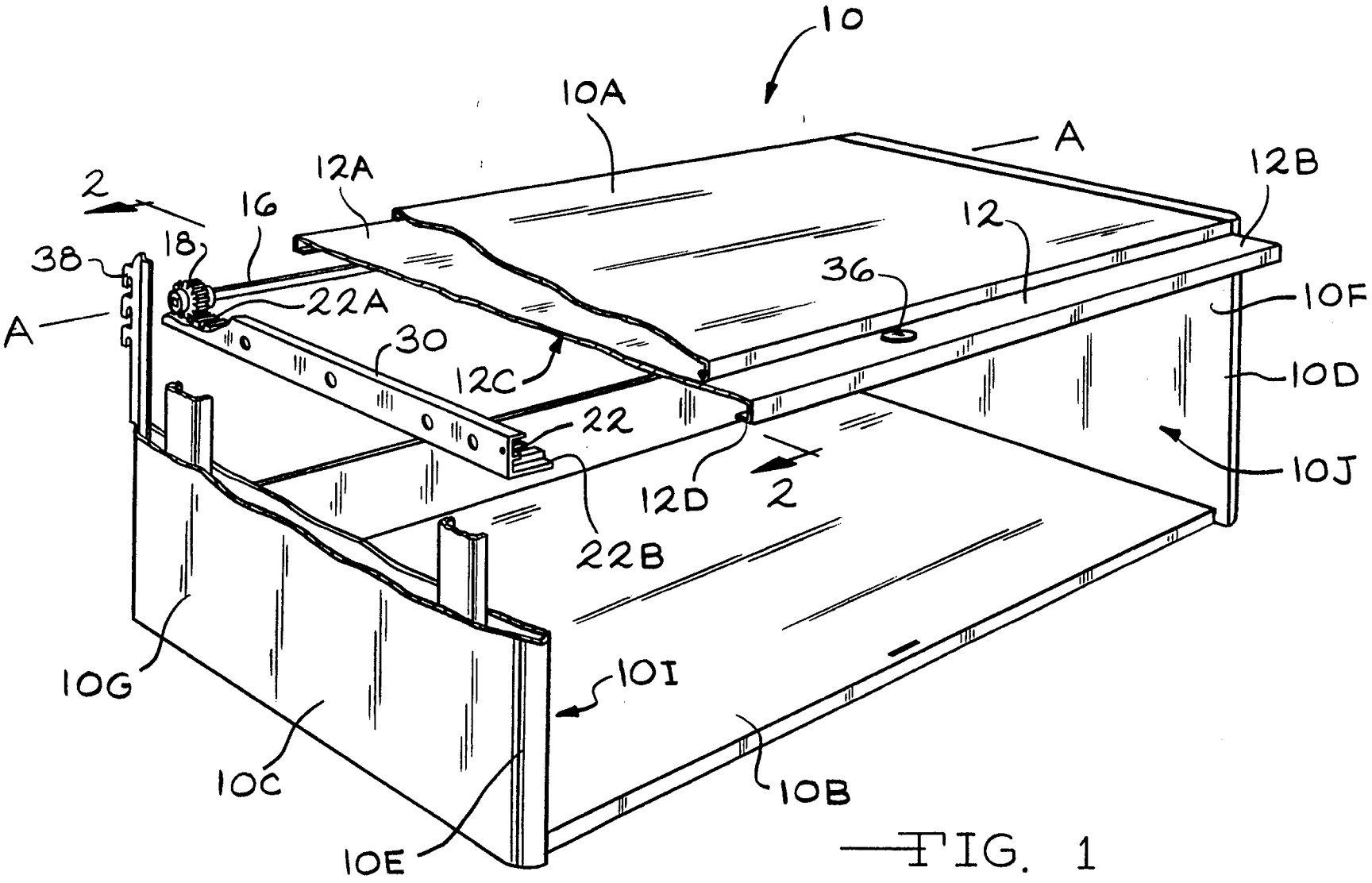
FIG. 1 is a perspective view of the cabinet unit 10 with a cut away portion showing the rack and pinion assembly.

FIGS. 1 to 4 show the cabinet unit 10 with the flipper door 12 of the present invention. FIG. 1 shows the cabinet unit or casing 10 and the flipper door 12 in the open position. In the preferred embodiment, the cabinet unit 10 is rectangular in shape with a top wall 10A, a bottom wall 10B and two opposed sidewalls 10C and 10D each having a front portion 10E and 10F and a back portion 10G (one shown) with an inner surface 10I and 10J therebetween. The walls of the cabinet unit 10 form a front opening 11 at the front portion 10E and 10F of the sidewalls 10C and 10D and a back opening at the back portion 10G of the sidewalls 10C and 10D. In a modified embodiment, a back wall which can be open or closed, is also provided thus allowing access to the cabinet from either end.

The flipper door 12 is mounted onto the front of the cabinet unit 10 and is of a shape such as to completely cover the front opening 11 of the cabinet unit 10 when in the closed position. The flipper door 12 is provided with a top portion 12A and a bottom portion 12B with an inside wall 12C therebetween and an inner lip 12D extending around the entire inside perimeter of the flipper door 12. The sidewalls 10C and 10D of the cabinet unit 10 extend beyond the bottom wall 10B of the cabinet unit 10 perpendicular to the axis A—A such that in the closed position the inner lip 12D along the bottom portion 12B of the flipper door 12 is in contact with the bottom wall 10B of the cabinet unit 10 which stops the movement of the flipper door 12. In the closed position, the flipper door 12 is flush with the two sidewalls 10C and 10D and the top wall 10A. The opening and closing mechanism of the flipper door 12 (to be described in detail hereinafter) is comprised of two identical sides, therefore, only one side will be described.

Figure 3:
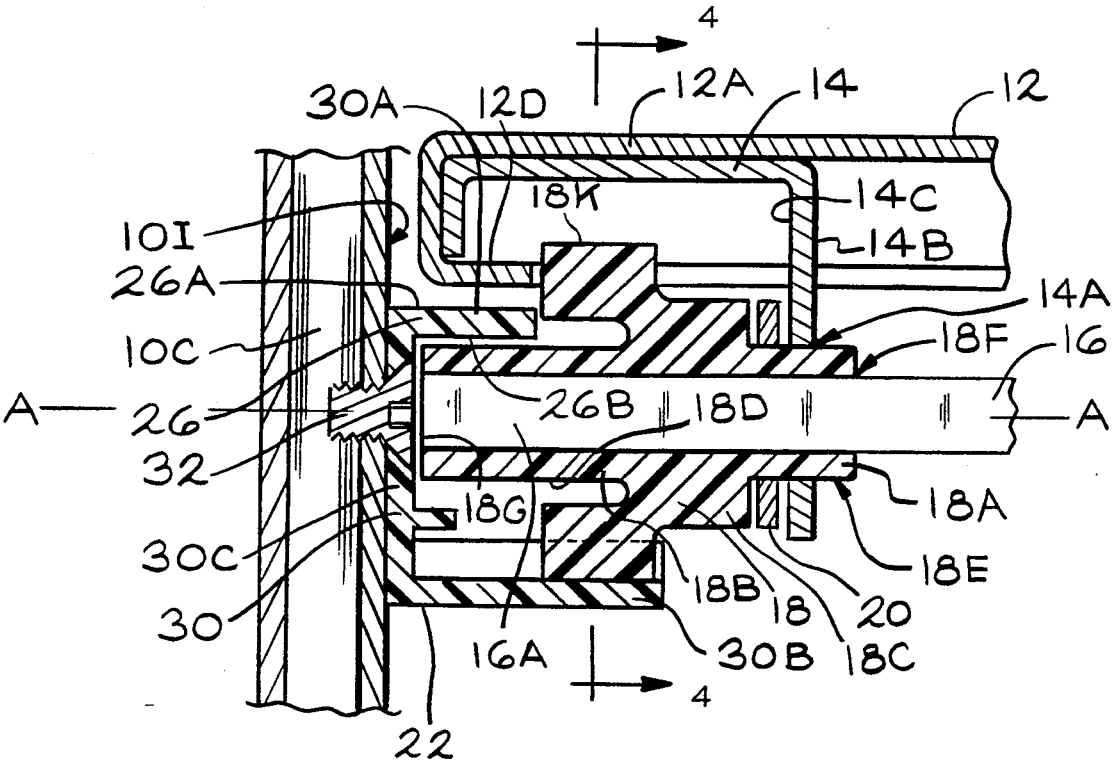
FIG. 3 is a cross-section front view of FIG. 2 along line 3—3 showing the positioning of pinion gear 18 in the rack 22 and the second extension 18B in relation to the guide ledge 26.
Figure 4:
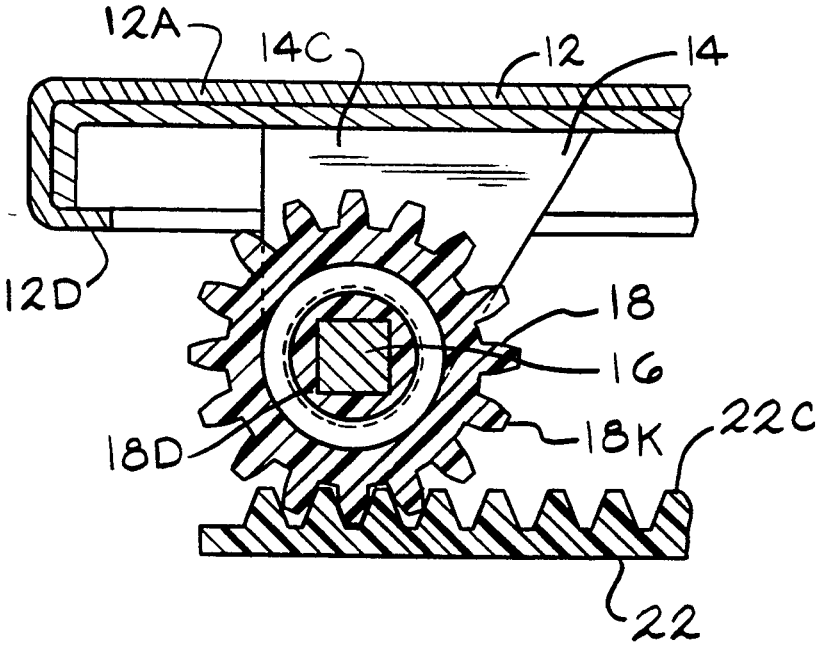
FIG. 4 is a cross-sectional side view of FIG. 3 along line 4—4 showing the axle 16 positioned through the pinion gear 18 and through the bracket 14.

A bracket 14 with an inner side 14B and an outer side 14C is mounted on the inside wall 12C of the flipper door 12 toward the top portion 12A of the flipper door 12 (FIGS. 3 and 4). The bracket 14 extends outward from the inside wall 12C of the flipper door 12 and is provided with an aperture 14A in the plane perpendicular to the axis A—A in the portion of the bracket 14 furthest from the flipper door 12. The length of the bracket 14 is such that the aperture 14A of the bracket 14 is spaced below and clear of the inner lip 12D of the flipper door 12 (FIG. 4).

As shown in FIG. 4, an axle 16 is mounted parallel to the axis A—A such that one end 16A of the axle 16 extends through the aperture 14A of the bracket 14. The bracket 14 is spaced down from the top portion 12A of the flipper door 12 such that upon closing the top portion 12A of the flipper door 12 pivots around the axle 16 without touching the top wall 10A of the cabinet unit 10. Additionally, the bracket 14 is mounted such that in the closed position, the portion of the flipper door 12 which extends above the axle 16, conceals the opening to the space provided in the cabinet unit 10 for storage of the flipper door 12.

A pinion gear 18 is mounted on the end 16A of the axle 16 with the end 16A inserted through the aperture 14A in the bracket 14. The pinion gear 18 has a circular cross-section (FIG. 4) and is provided with a first extension 18A and a second extension 18B with a central portion 18C therebetween (FIG. 3). The central portion 18C is provided with first teeth 18K on the outside surface to engage the second teeth 22C of the rack 22 (to be described hereinafter) to allow for movement of the flipper door 12. The first extension 18A and the second extension 18B protrude outward from opposite sides of the central portion 18C of the pinion gear 18 parallel to the axis A—A (FIG. 4) The first extension 18A and the second extension 18B are smaller in diameter than the central portion 18C of the pinion gear 18 and have a smooth outer surface 18D and 18E, respectively. The pinion gear 18 is also provided with a center bore 18F which extends parallel to the axis A—A through the entire pinion gear 18. The axle 16 extends through the center bore 18F of the first extension 18A and the central portion 18C and into the second extension 18B. In the preferred embodiment, the first and second extension 18A and 18B have a similar diameter of a size such as to precisely accommodate the center bore 18F. The center bore 18F has a cross-section similar to the axle 16 which is slightly greater in size such that the pinion gear 18 easily fits onto the end 16A of the axle 16. In the preferred embodiment, the axle 16 and similarly the center bore 18F have a square cross-section (FIG. 4) and such that the gear 18 is free to move on the shaft 16, parallel to the axis A—A. Preferably, the axle 16 does not extend past the bore opening 18G on the end of the second extension 18B, although the axle 16 is able to slide parallel to the axis A—A within the center bore 18F of the pinion gear 18 and past the bore opening 18G of the second extension 18B. This movement allows for any variation in the length of the axle 16 and also allows for easy removal and replacement of the axle 16 or pinion gear 18 in case of damage.

As shown in FIG. 3, the pinion gear 18 is mounted on the end 16A of the axle 16 such that the central portion 18C of the pinion gear 18 is adjacent the outer side 14C of the bracket 14 and the first extension 18A extends through the aperture 14A in the bracket 14. The first extension 18A surrounds the portion of the axle 16 which is located within the aperture 14A of the bracket 14. The diameter of the first extension 18A is slightly less than the diameter of the aperture 14A of the bracket 14 such that the first extension 18A can easily rotate within the aperture 14A while preventing the flipper door 12 from wobbling. The smooth outer surface 18D of the first extension 18A allows for easy rotation of the pinion gear 18 and subsequently the axle 16 within the bracket 14. In the preferred embodiment, the first extension 18A of the pinion gear 18 is constructed of plastic or metal which further enables the flipper door 12 to pivot smoothly on the axle 16 by reducing friction between the bracket 14 and the pinion gear 18 during movement. Preferably, a spacing washer 20 is also mounted between the outer side 14C of the bracket 14 and the central portion 18C of the pinion gear 18 to provide spacing between the pinion gear 18 and the bracket 14.

Figure 2:
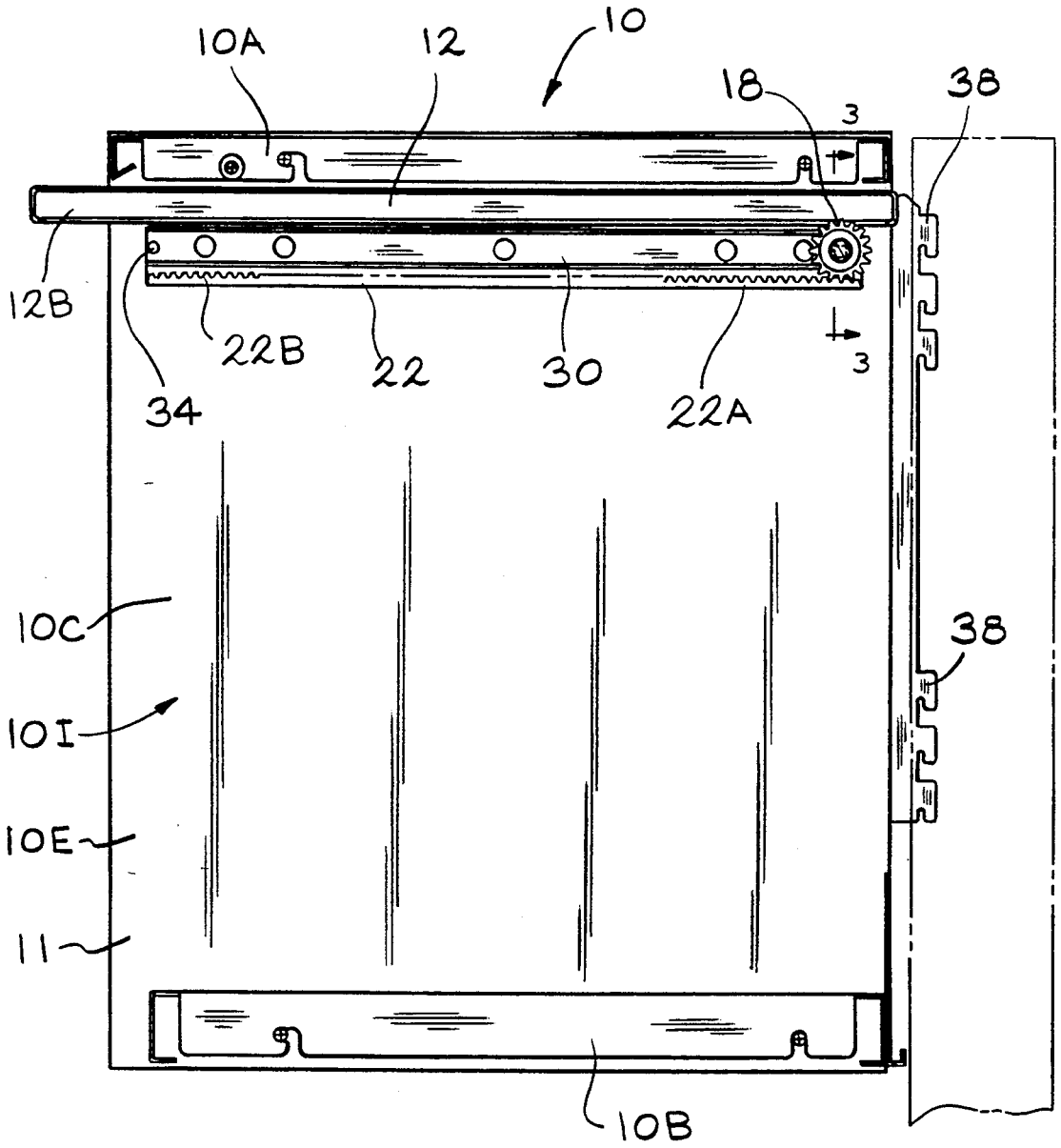
FIG. 2 is a cross-sectional view of the cabinet unit 10 of FIG. 1 along line 2—2 showing the placement of the flipper door 12 when stored in relation to the rack and pinion assembly and the top wall 10A of the cabinet unit 10.

A rack 22 having a distal end 22A and proximal end 22B is mounted on the inner surface 10I and 10J of the sidewalls 10C and 10D perpendicular to the axis A—A (FIGS. 1 and 2). The proximal end 22B of the rack 22 is located in the front portion 10E of the sidewall 10C near the front opening 11 of the cabinet unit 10. The rack 22 is of a length such as to span the entire length of the sidewall 10C and is spaced down from the top wall 10A such as to allow for the flipper door 12 to be stored inside the cabinet unit 10 below and parallel to the top wall 10A when in the open position (FIG. 1). The rack 22 contains second teeth 22C which point upward toward the top wall 10A of the cabinet unit 10. The width of the rack 22 and the width and spacing of the second teeth 22C are such as to fully and smoothly engage the first teeth 18K of the pinion gear 18.

A guide ledge 26 (FIG. 3) having an upper surface 26A and a lower surface 26B and is mounted above and parallel to the rack 22 along the entire length of the rack 22 perpendicular to the axis A—A. The width of the guide ledge 26 is less than the width of the rack 22 and is approximately equal to the width of the second extension 18B of the pinion gear 18 such that any movement of the pinion gear 18 on the length of the axle 16, parallel to the axis A—A, causes the end of the second extension 18B containing the bore opening 18G to come in contact with the inner surface 10I of the sidewalls 10C at approximately the same time as the central portion 18C of the pinion gear 18 makes contact with the edge of the top leg 30A which forms the guide ledge 26. The added width of the rack 22 allows the first teeth 18K of the central portion 18C of the pinion gear 18 to engage the second teeth 22C of the rack 22 without the lower surface 26B of the guide ledge 26 and also allows the smaller diameter second extension 18B to be positioned just below the lower surface 26B of the guide ledge 26. The guide ledge 26 is spaced above the rack 22 such that the outer surface 18E of the second extension 18B is adjacent the lower surface 26B of the guide ledge 26 when the first teeth 18K of the central portion 18C of the pinion gear 18, are rotatably engaged within the second teeth 22C of the rack 22. The second extension 18B of the pinion gear 18 is spaced within the guide ledge 26 area such that the outside surface 18E of the second extension 18B rotatably glides just below the lower surface 26B of the guide ledge 26 during movement of the flipper door 12. The upper surface 26A of the guide ledge 26 is spaced downward from the top wall 10A of the cabinet unit 10 such as to allow the flipper door 12 to slide between the upper surface 26A of the guide ledge 26 and the top wall 10A of the cabinet unit 10. In the preferred embodiment, the guide ledge 26 is positioned as close to the top wall 10A of the sidewall 10C as possible to maximize storage area within the cabinet unit 10 while allowing room for storage of the flipper door 12. The inner lip 12D of the flipper door 12 preferably slidably rests upon the upper surface 26A of the guide ledge 26 to assist in stabilizing the flipper door 12 during movement. In the preferred embodiment, the guide ledge 26 and the rack 22 are formed from a single U-shaped unitary member 30 mounted to the inner surface 10I of the sidewall 10C by metal screws 32. The U-shaped unitary member 30 is mounted such that the legs 30A and 30B of the U-shaped unitary member 30 extend outward from the inner surface 10I of the sidewall 10C, parallel to the axis A—A wherein the top leg 30A of the U-shaped member forms the guide ledge 26 and the bottom leg 30B of the U-shaped member forms the rack 22. In the preferred embodiment, the pinion gear 18, as well as the rack 22 and guide ledge 26 or U-shaped member 30, are constructed of plastic or metal such that contact between the parts, mainly between the pinion gear 18 and the rack 22, is smooth and frictionless.

As shown in FIG. 2, a stop member 34 is mounted on the inside surface 10I of the front portion 10E of the sidewall 10C at the proximal end 22B of the rack 22 within the area of the guide ledge 26. The stop member 34 projects into the path of the guide ledge 26, parallel to the axis A—A, such that the second extension 18B of the pinion gear 18 comes in contact with the stop member 34 upon the pinion gear 18 reaching the proximal end 22B of the rack 22. In the preferred embodiment, the stop member 34 is a metal screw of a length such as to effectively engage the second extension 18B. Preferably, the flipper door 12 is also provided with a locking mechanism 36 located in the bottom portion 12B of the flipper door 12 (FIG. 1). The locking mechanism 36 is located such that the key entry portion which extends outward perpendicular to the axis A—A from the flipper door 12 does not prevent storage of the flipper door 12 below the top wall 10A and does not require additional spacing beyond that originally provided for the flipper door 12 (FIG. 1). In the preferred embodiment as shown in FIGS. 1 and 2, the cabinet unit 10 is mounted onto a wall (not shown) by means of mounting hooks 38 which are inserted into holes (not shown) in the wall. Preferably, the cabinet unit 10 is elevated off the ground such that there is a space below the bottom wall 10B of the cabinet unit 10 such that when the flipper door 12 is in the closed position the bottom portion 12B of the flipper door 12 may be easily grasped to open the flipper door 12.

IN USE

The flipper door 12 is mounted onto the cabinet unit 10 such that in the open position the flipper door 12 is stored adjacent and parallel to the top wall 10A of the cabinet unit 10 (FIG. 1). As shown in FIG. 2, in the open position the pinion gear 18 rests within the distal end 22A of the rack 22 located on the back portion 10G of the sidewall 10C and the bottom portion 12B of the flipper door 12 extends outward from the cabinet unit 10 beyond the front opening 11 of the cabinet unit 10 perpendicular to the axis A—A. The extension of the flipper-door 12 past the front opening 11 of the cabinet unit 10 is due to the dimensions of the cabinet unit 10 wherein the height of the cabinet unit 10 is greater than the depth of the cabinet unit 10. To close the flipper door 12, the flipper door 12 is pulled straight out of the cabinet unit 10 perpendicular to the axis A—A until the second extension 18B of the pinion gear 18 encounters the stop member 34. The stop member 34 prevents the pinion gear 18 from extending beyond the rack 22 and thus prevents the flipper door 12 from coming off of the cabinet unit 10. As the flipper door 12 is pulled out, the first teeth 18K of the pinion gear 18 rotatably engage the second teeth 22C of the rack 22 which allows the flipper door 12 to move smoothly outward. The flipper door 12 moves uniformly when pulled out due to the axle 16 extending between the two pinion gears 18 (one shown) which ensures that the pinion gears 18 move in unison. During horizontal movement, the second extension 18B of the pinion gear 18 assists in stabilizing the flipper door 12. The second extension 18B rotatably glides along just below the lower surface 26B of the guide ledge 26 and prevents the pinion gear 18 from lifting out of the rack 22. The outer surface 18E of the second extension 18B encounters the lower surface 26B of the guide ledge 26 as the pinion gear 18 is lifted out of the rack 22. Thus, the second extension 18B along with the guide ledge 26 prevents the first teeth 18K of the pinion gear 18 from lifting out of the second teeth 22C of the rack 22 and helps the flipper door 12 stay in track during movement. The smooth outer surface 18E of the second extension 18B ensures that any contact between the lower surface 26B of the guide ledge 26 and the outer surface 18E of the second extension 18B will not affect the smooth movement of the flipper door 12.

The upper surface 26A of the guide ledge 26 also provides stability_to the movement of the flipper door 12. The inner lip 12D of the flipper door 12 extends downward such that when the flipper door 12 is stationary the inner lip 12D rests upon the upper surface 26A of the guide ledge 26, thus helping to prevent a tilting motion around the axle 16 when the flipper door 12 is horizontal. In the closed position, the pinion gear 18 is located in the proximal end 22B of the rack 22 and the inner lip 12D on the top portion 12A of the flipper door 12 is adjacent the proximal end 22B of the rack 22 such that the flipper door 12 completely covers the front opening 11 and is flush with the sidewalls 10C and 10D and top wall 10A.

It is intended that the foregoing description be only illustrative of the present invention and that the present invention be limited only by the hereinafter appended claims.

I claim:

1. A cabinet unit comprising;

(a) a casing means having a top wall and a bottom wall spaced apart parallel to a horizontal axis with two opposed sidewalls, connected to the top wall and bottom wall each sidewall having a front portion and a back portion with an inner surface therebetween wherein the walls together provide a front opening in the casing;

(b) a flipper door means having a top portion and a bottom portion adapted for covering the front opening;

(c) a pair of rack means mounted on the inner surface of each sidewall of the casing parallel to a plane of the horizontal axis each having a proximal end located toward the front opening in the casing and a distal end at the back portion and each with first teeth pointed toward the top wall;

(d) a pair of pinion gear means mounted on the door means each having a first extension and a second extension with a central portion having an outer surface extending therebetween and a center bore extending through the first extension, central portion and second extension wherein the outer surface of the central portion is provided with second teeth to rotatably engage the first teeth of the rack means;

(e) a pair of guide means located above and parallel to the rack means wherein the second extension of the pinion gear means slidably engages the guide means to provide guidance for the flipper door means during opening and closing;

(f) a pair of bracket means mounted at the top portion of the flipper door means provided with an inner side and an outer side with an aperture therebetween in a plane perpendicular to the axis wherein the first extension of the pinion gear means extends through the aperture of the bracket means such that the central portion of the pinion gear means is adjacent the outer side of the bracket means wherein the bracket means pivotally mounts the flipper door means onto the casing means;

(g) an axle means extending parallel to the axis having two opposed ends wherein each end extends through the aperture in the bracket means and through the center bore of the pinion gear means for mounting the pair of pinion gear means onto the flipper door such that the axle means and pinion gear means rotate together and wherein the pinion gear means is slidable along the axle means to the extent permitted by the guide means and the bracket means; and (h) a pair of stop means mounted at the front portion of each sidewall and located in line with the guide means to prevent the second extension of the pinion gear means from moving off the guide means when the door is closed.

2. The cabinet unit of claim 1 wherein the rack means and the guide means are constructed as a unitary U-shaped piece.

3. The cabinet unit of claim 1 wherein the stop means is a metal screw.

4. The cabinet unit of claim 1 wherein the axle has a square cross-section.

5. The cabinet unit of claim 1 wherein the bore of the pinion gear means has a cross-section similar to the cross-section of the axle means and which prevents rotation of the gear means on the axle.

6. The cabinet unit of claim 1 wherein the bottom portion of the flipper door is provided with a locking means.

7. The cabinet unit of claim 1 wherein the locking means is a key and lock assembly.

8. The cabinet unit of claim 1 wherein there is a spacing washer located between the outer side of the bracket means and the central portion of the pinion gear means.

* * * * *